US008151767B2

(12) United States Patent
Pursifull et al.

(10) Patent No.: US 8,151,767 B2
(45) Date of Patent: Apr. 10, 2012

(54) FUEL CONTROL FOR DIRECT INJECTION FUEL SYSTEM

(75) Inventors: Ross Dykstra Pursifull, Dearborn, MI (US); James Knight, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1240 days.

(21) Appl. No.: 11/835,940

(22) Filed: Aug. 8, 2007

(65) Prior Publication Data

US 2009/0038587 A1 Feb. 12, 2009

(51) Int. Cl.
*F02M 69/16* (2006.01)
*F02M 59/20* (2006.01)

(52) U.S. Cl. ..... 123/491; 123/179.17

(58) Field of Classification Search ..... 123/179.3, 123/179.7, 179.9, 179.12, 179.16, 179.17, 123/491, 456, 496, 497, 495
See application file for complete search history.

(56) References Cited

U.S. PATENT DOCUMENTS 5,555,872 A 9/1996 Takeuchi et al.
5,572,964 A * 11/1996 Cogneville et al. ..... 123/179.17
5,743,236 A * 4/1998 Kawakami ..... 123/491
5,842,454 A 12/1998 Miwa et al.
5,927,253 A * 7/1999 Oyafuso et al. ..... 123/456
6,276,340 B1 * 8/2001 Kato ..... 123/491
6,408,822 B1 * 6/2002 Rembold et al. ..... 123/447
6,474,310 B2 11/2002 Joos et al.
6,708,661 B1 * 3/2004 Aubourg et al. ..... 123/179.16
6,889,656 B1 5/2005 Rembold et al.
7,021,261 B2 * 4/2006 Joos et al. ..... 123/179.17
7,055,505 B2 6/2006 Washeleski et al.
7,093,576 B2 * 8/2006 DeRaad ..... 123/179.17
7,412,953 B2 * 8/2008 Shimazaki et al. ..... 123/179.16
7,448,361 B1 * 11/2008 Pursifull et al. ..... 123/456
7,934,490 B2 * 5/2011 Kurata et al. ..... 123/543
2004/0074479 A1 * 4/2004 Joos et al. ..... 123/497
2006/0200300 A1 9/2006 Bryan et al.
2006/0225695 A1 * 10/2006 Fukasawa ..... 123/305
2008/0218105 A1 * 9/2008 Wunderlich ..... 318/362

* cited by examiner

*Primary Examiner* — Stephen K Cronin
*Assistant Examiner* — Arnold Castro
(74) *Attorney, Agent, or Firm* — Allan J. Lippa; Alleman Hall McCoy Russell & Tuttle LLP

(57) ABSTRACT

A method for controlling a direct injection fuel system of a vehicle, the method comprising generating fuel pressure via an electronically controlled lift pump and a second pump, the electronically controlled lift pump actuated responsive to a command during an initial start-up duration, translating the fuel pump command via a first mapping to drive the fuel pump, where the first mapping includes mapping a default signal to active pump operation and after the initial start-up duration, translating the fuel pump command via a second mapping to drive the fuel pump where the second mapping includes mapping the default signal to pump deactivation. This method may achieve near immediate lift pump actuation upon system power-up while preserving favorable degradation modes and maintaining a simple, cost-effective inter-module communication scheme.

16 Claims, 5 Drawing Sheets

FUEL CONTROL FOR DIRECT INJECTION FUEL SYSTEM

BACKGROUND AND SUMMARY

During a vehicle start operation, it may be advantageous to provide fuel pressure to the fueling system of the engine as fast as possible, especially in a direct injection engine system. Various approaches have been described to achieve such a feature.

While low pressure (e.g., port injection) single speed (single pump voltage) mechanical returnless fuel systems may achieve lift pump operation with no minimal delays in application of the fuel lift pump using a default, on-command, for the lift pump. However, such a lift pump system may operate ineffectively in higher pressure, direct injection systems since a single speed fuel system results in design tradeoffs that injure lift pump durability and increase lift pump energy consumption. Thus, variable speed/voltage pumps have been applied in direct injection applications.

Furthermore, when using a variable speed electronically controlled pump in direct injection applications, prior approaches have utilized a default, off-command, for the pump to address various degradation conditions (so that inadvertent pump operation is less likely to occur). However, this default-off state adds to delays in providing sufficient fuel pump pressure, since various systems must first initialize before the fuel pump may be reliably activated. Other solutions use complex wiring and communications between the PCM and lift pump control module to achieve the goal of rapid lift pump voltage application with favorable behaviors in degraded states.

The inventors herein have recognized the above issues, and attempted to address the conflicting requirements of the prior art, in one embodiment, by a method for controlling a fuel system of a vehicle. The method may comprise generating fuel pressure via an electronically controlled pump, the electronically controlled pump actuated responsive to a command; during an initial start-up duration, translating the fuel pump command via a first mapping to drive the fuel pump, where the first mapping includes mapping a default signal to active pump operation; and after the initial start-up duration, translating the fuel pump command via a second mapping to drive the fuel pump where the second mapping includes mapping the default signal to pump deactivation.

In one example, it is thus possible to provide a system that does not activate the fuel pump when a command is absent, avoids activating the fuel pump in response to various system degradation conditions, yet still provides variable speed pump operation with pump activation upon control system initialization without waiting for initialization of the control system. Note, however, that various other alternative and/or additional functions may be achieved. Further, note that various approaches may provide a first and second mapping, such as via an algorithm in a processor, an electrical circuit, etc. Further, note than the initial duration may include a time limit, or a non-time-based limit (e.g., it may include a limit related to a number of calculations performed by a processor, etc).

DETAILED DESCRIPTION

As will be described in further detail herein, the present application relates to achieving a low costs fuel system for a vehicle that can enable improved starting with earlier application of a fuel pump following initial key-on operation. In one example, such operation is achieved with reduced wiring requirements while still achieving acceptable default operation in the presence of degradation.

Figure 1:
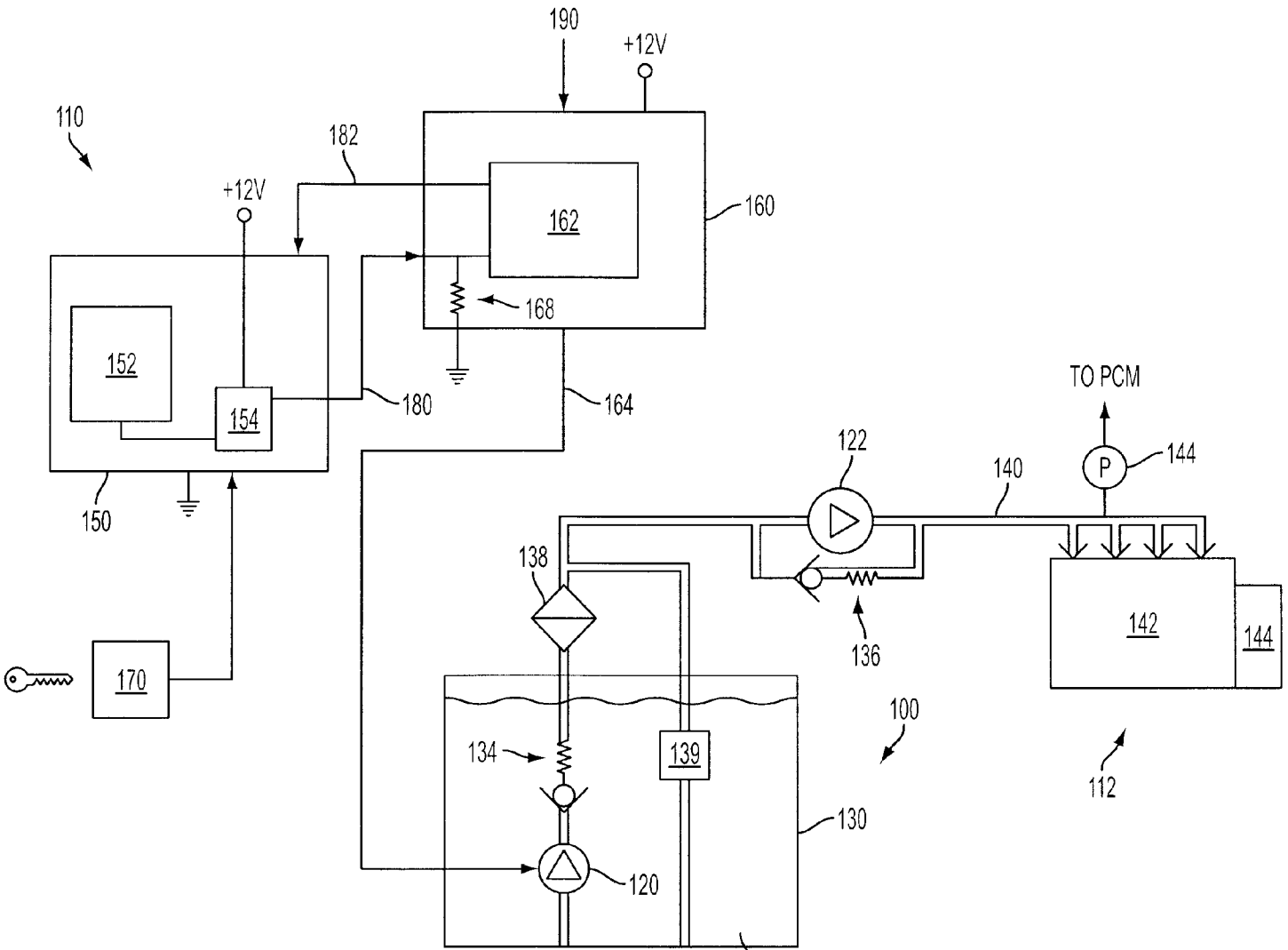
FIG. 1 shows an example system diagram including a fuel system for an engine of a vehicle.

Referring now to FIG. 1, an example fuel system 100 is illustrated in communication with a control system 110, and vehicle powertrain system 112. The vehicle powertrain system may include an engine 142, which may be a gasoline engine, manual and/or automatic transmission 144, and other components.

Fuel system 100 may be a direct injection high pressure fuel system, including an electronic multi-speed lift pump 120 and a mechanical high pressure pump 122. Lift pump 120 may be coupled upstream of the high pressure pump 122, and may be located with a fuel tank 130 containing fuel 132. Lift pump 120 may be a two-speed pump, continuously variable speed pump, etc., and may operate to increase fuel pressure from tank pressure to an intermediate pressure, before fuel pressure is raised to an injection pressure via pump 122. Various check valves, filters, and other devices may further be included in the fuel system, such as check valve 134 coupled downstream of pump 120, and check valve 136 coupled around pump 122. Check valve 134 operates to prevent backflow into pump 120, and check valve 136 operates as a path around pump 122. Further, a filter 138 may be positioned downstream of check valve 134, but upstream of a bypass regulator 139 coupled in the tank 130.

The high pressure pump 122 lead to a fuel rail 140, which delivers fuel to a plurality of direct injection, in-cylinder, fuel injectors of engine 142. Further, a pressure sensor 144 may be coupled to the fuel rail, and deliver a signal to the control system indicative of fuel rail pressure that is used to control the fuel pumps, and/or other operations, such as engine operation, etc.

Continuing with FIG. 1, a portion of the control system 110 may include a powertrain control module (PCM) 150 and a lift pump control module 160, as well as various sensor and/or actuator signals. The PCM may include various components, such as RAM, ROM, I/O, processors, etc. The PCM may further include instructions executable by the processor to carry out various operations, as described in further detail herein. PCM 150 specifically includes a microcontroller 152 communicating with a driver 154. While only a single processor and driver are illustrated, various others may be included.

In this example, microcontroller 152 may include code for controlling engine and/or transmission operation response to various vehicle sensors, operator commands, etc., including controlling fuel injection, exhaust components, and others. Further, microcontroller 152 may proceed through an initialization sequence upon vehicle starting, such as initiated responsive to a vehicle operator key-on operation through ignition interface 170. In one example, PCM 150 receives power upon a key-on event. Note that while this example illustrate key-on operation via a physical key 172, various other approaches may be used, such as digital signatures, wireless communications, etc. Further, various other power-on events may be used, such as a door-ajar signal, a key insertion signal, etc. The initialization sequence may include initial power up and initializing before taking active control and adjustment of various output signals that may be set at default levels during such conditions. After initialization, PCM 152 adjusts the various output signals responsive to measured operating conditions, code contained therein, etc. Also, as indicated in FIG. 1, in this embodiment, there is no need to route an ignition signal (e.g., 170) to module 160, although such a modification may be used, if desired.

Driver 154 enables translation of microcontroller level control signals (e.g., lower current, 0-5V signals) to inter-module communication level control signals (e.g., high current, 0-12V signals) Specifically, driver 154 generates a lift pump control signal 180 that is transmitted to module 160. Signal 180 may be a pulse width (duty cycle, frequency, etc.) modulated signal, and be either active high or active low. An active high signal indicates that when the signal 180 is high (e.g., 12V), this corresponds to applying pump voltage and supplying electrical energy to the lift pump 120 driven by the signal (via module 160, as noted below). Similarly, an active low signal indicates that when the signal 180 is low (e.g., 0V, ground), this corresponds to applying pump voltage and supplying electrical energy to the lift pump 120 driven by the signal (via module 160, as noted below).

Module 160 includes a microprocessor 162 or other application specific integrated circuit (ASIC) configured to translate incoming signal 180 coupled via pull down resistor 168 into a driving signal 164 delivered to pump 120 for controlling pump actuation (e.g., pump speed). Further, module 160 may communicate diagnostic information back to PCM 150 via signal 182. Module 160 translates the incoming command signal 180 to the driving signal 164 to enable earlier application of the lift pump during and following PCM initialization, yet still retain adequate control and degradation operation. Further, module 160 receives a restraint deployment signal (RCM) 190. The table below illustrates example operation of the restraint deployment operation.

| RCM to Module 160 Signal Frequency | Definition | Module 160 "Read" |
|---|---|---|
| Open or no signal | No communication | Enable pump output |
| 10 Hz | Normal operation | Enable pump output and clear disable/override flags |
| 250 Hz | Deployment Event | Enable pump output |
| 500 Hz-250 Hz alternating | Valid "Off" command | Disable pump output if and only if: A total of three (3) 500 Hz pulses and a total of three (3) 250 Hz pulses are detected in any order within any 30 msec window. 500 Hz pulse determined by: $V_{high}$ >=4.5 V for 1.0 ± 0.1 msec followed by $V_{low}$ <2.5 V for 1.0 ± 0.1 msec within 2.0 ± 0.2 msec.; 250 Hz pulse determined by: $V_{high}$ >=4.5 V for 2.0 ± 0.1 msec followed by $V_{low}$ <2.5 V for 2.0 ± 0.1 msec within 4.0 ± 0.2 msec. Set pump control output duty cycle to 0 within 10 msec following the detection of the three 500 Hz and three 250 Hz pulses within any 30 msec window. |

The lift pump control module further communicates the restraint deployment to the PCM via the diagnostic signal 182, which is a redundant communication path.

In one particular example, to enable improved vehicle starting, driver 154 is configured to be in the active state by default (including before any command from the microcontroller 152 is generated), where if the signal is active, the fuel pump is actuated. In one embodiment, the active state corresponds to 100% active duty cycle. Specifically, a 100% active duty cycle received by module 160 is translated to command the fuel pump duty cycle to 100% during an initial duration after key-on; but then alternatively translated thereafter so that as soon as the microcontroller 152 was powered up, initialized, and performing control so that the PCM was issuing a duty cycle, such signal would control the pump. In this way, even before the PCM is powered up, initialized, and performing control, voltage can be applied to the fuel pump. I.e., fuel pump voltage can be applied immediately because the fuel pump command 180 would be in the active state at PCM power-up. Then, once the PCM dynamically controls the command signal, the module enables the dynamic control to be passed to the pump so that the pump follows the dynamic PCM control.

Further, to address various degradation conditions, module 160 operates to modify the received command signal differently before and after an initial duration, which in one example includes an initial time-out. Specifically, after the initial time-out, the module does not provide pump activation responsive to the default command. The translation and time-out operation of module 160 is described further with regard to FIG. 2-3, for example.

Figure 2:
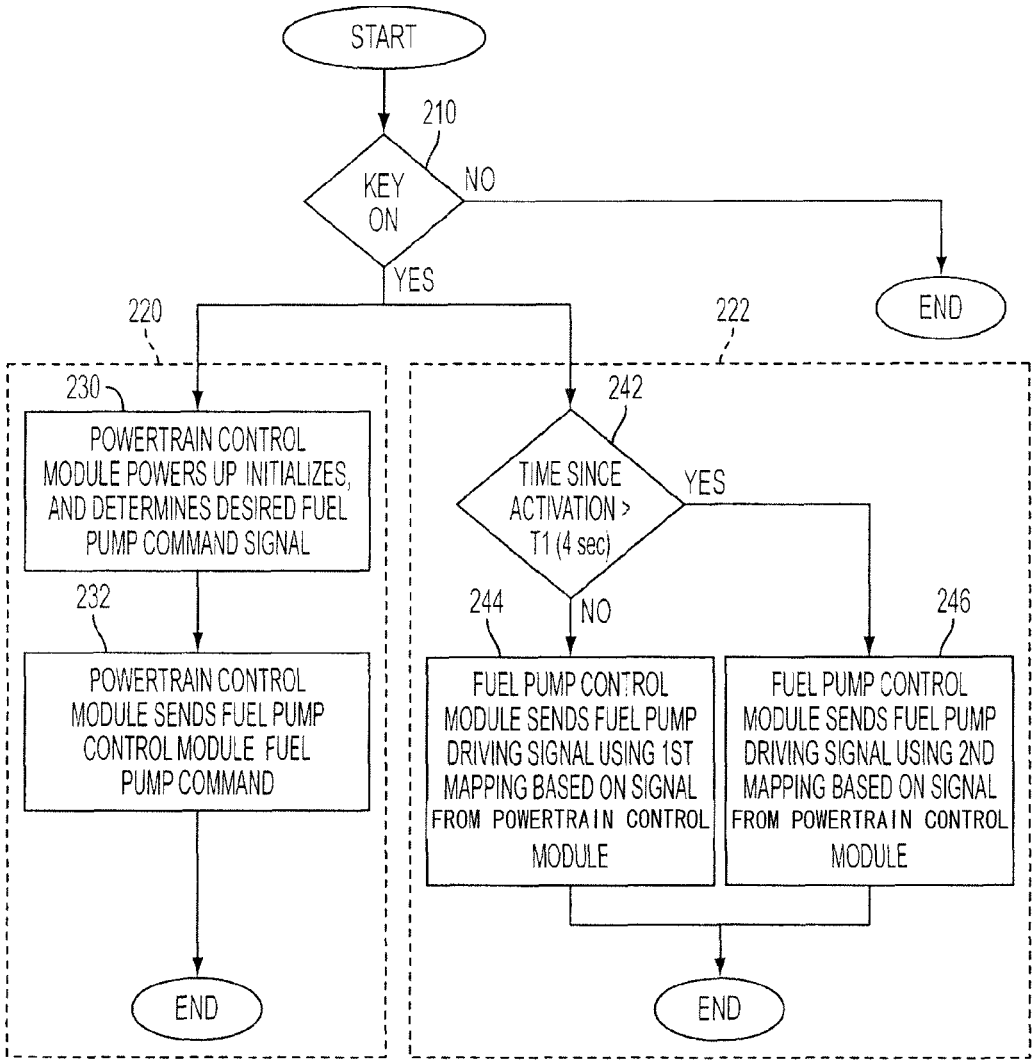
FIG. 2 shows an example high level flow chart for controlling system operation.

Referring now to FIG. 2, a high level flow chart illustrates various operation. Note that the flow chart may represent code and/or instructions encoded in one or both of 152 and 162, as indicated.

Responsive to key-on operation at 210, both processors receive power and commence operating. Specifically, PCM 150 operates as indicated at 220 and module 160 operates as indicated at 222. However, in various alternative examples, the functions may be combined and/or further divided.

At 230, the PCM powers-up, initializes, and determines a desired fuel pump command signal based on various operating parameters, such as rail pressure, engine operation, ambient temperature, ambient pressure, etc. Then, at 232, the PCM sends the fuel pump command via signal 180 to module 160. Such operation is repeatedly performed to provide variable lift pump actuation responsive to operating conditions. Further, because the default state of the driver 154 corresponds to activation (which may be full, or maximum, actuation of the fuel pump 120), the above operation results in activation of the fuel pump after key-on limited only by the start-up/initialization of processor/ASIC 162, which can be significantly faster than processor 152, since processor/ASIC 162 may be considerably simpler than processor 152.

At 242, module 160 determines whether a time since activation is greater than a limit time T1, which in one example may be set to approximately 0.4 seconds. If so, in 244 module 160 sends a fuel pump a driving signal 164 using a first mapping based on signal 180 received from the PCM. Alternatively, in 246 module 160 sends the fuel pump driving signal 164 using a second mapping based on signal 180 received from the PCM. The mapping may be illustrated via the following table. Note that in this example, it is only the 100% duty cycle meaning that differs depending on time since power was applied to the fuel pump module.

| Fuel Pump Command 180 (duty cycle) | Pump Module power-up timer <0.4 second | Pump Module power-up timer >0.4 second |
|---|---|---|
| FPC = 0% | Pump Duty Cycle 164 = 0% | Pump Duty Cycle = 0% |
| 0% < FPC < 4% | Pump Duty Cycle = 0% | Pump Duty Cycle = 0% |
| 4% <= FPC <= 50% | Pump Duty Cycle = 2 * FPC | Pump Duty Cycle = 2 * FPC |
| 50% < FPC < 55% | Pump Duty Cycle = 100% | Pump Duty Cycle = 100% |
| 55% < FPC < 100% | Pump Duty Cycle = 0% | Pump Duty Cycle = 0% |
| FPC = 100% | Pump Duty Cycle = 100% | Pump Duty Cycle = 0% |

Thus, upon power-up, the fuel pump module 160 receives a steady "on" command from the PCM (where the PCM microcontroller 162 is not yet dynamically controlling the signal outputs). Within the first second of operation, the PCM duty cycle begins dynamic control, and the fuel pump module 160 passes this dynamic command through to the pump. However, should the fuel pump module get an "on command" but not see a duty cycle within the time limit (T1), it times out and the fuel pump is effectively disabled.

Figure 3:
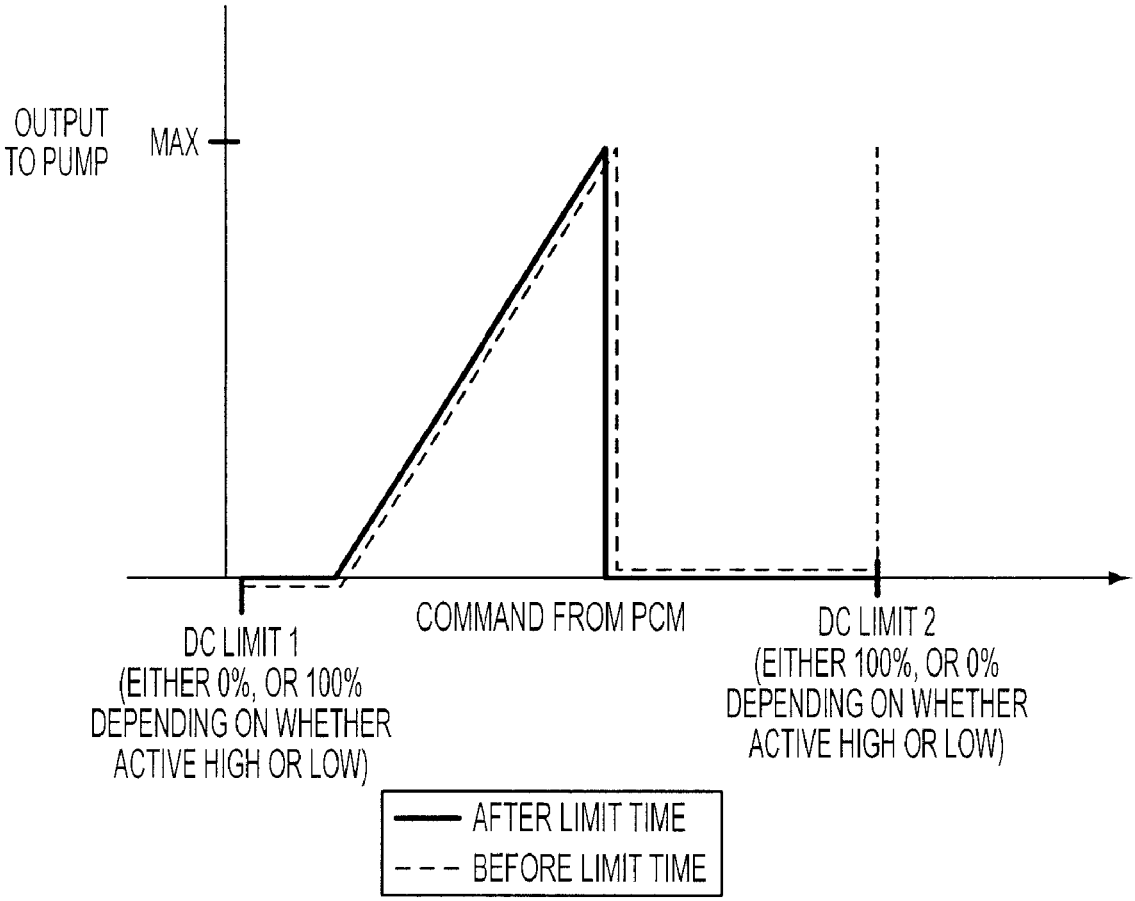
FIG. 3 show example mappings for enabling control of the fuel system.

FIG. 3 further illustrates the first and second mapping/translation performed by module 160. Specifically, the dashed line shows the first mapping, and the solid line shows the second mapping. As noted above, depending on the duration (which may be a timer, number of calculations, number of clock pulses, etc.) the different mappings are applied to drive the fuel pump. The mappings effectively enable the module to pass through mid-range duty cycles before and after time reaches the limit, but before the limit, pass through a fully active default command, whereas after the limit, such default commands are not passed through. Further, the mapping accounts for degradation where the command signal is stuck high, and/or stuck low.

Figure 4:
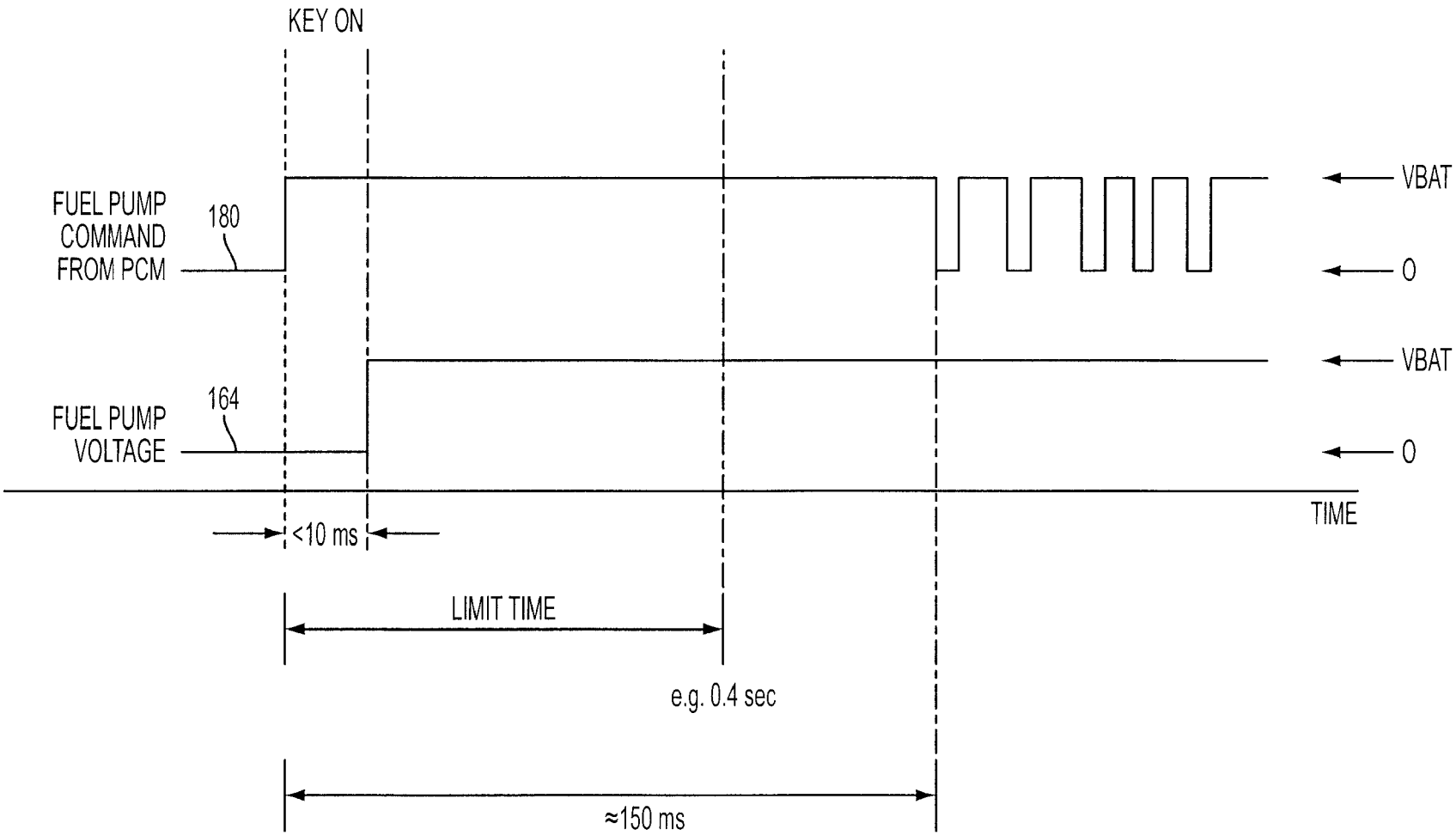
FIG. 4 shows an example fuel system timing diagram.

FIG. 4 shows key-on behavior according to operation as described herein as a prophetic example. The top graph shows the fuel pump command signal from the PCM (e.g., signal 180) and the bottom graph shows the fuel pump voltage (e.g., via signal 164). As illustrated in the figure, the fuel pump module 160 does not apply voltage to the fuel pump without a corresponding PCM command. Further, in a situation where no degradation is present, fuel pump voltage is applied almost immediately (e.g., less than 10 ms). Finally, should a short-to-power degradation exist in signal 180, fuel pump voltage is only applied for the limit time, e.g. 0.4 seconds.

Figure 5A:
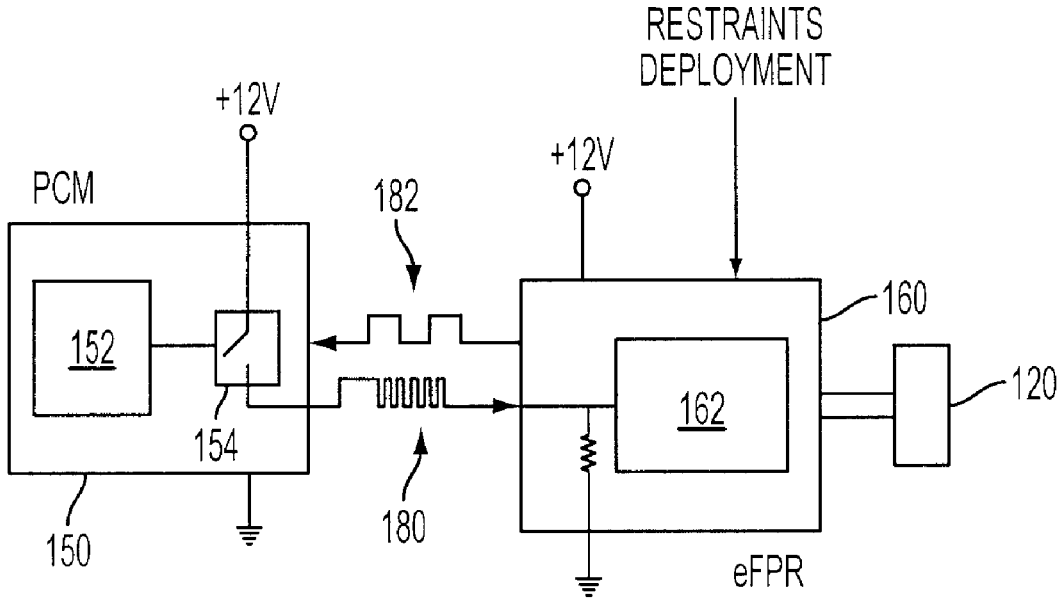
FIGS. 5A-5B shows additional system details for various default configurations.

FIG. 5 shows further details comparing the configuration for active high and active low embodiments. Specifically, FIG. 5A shows a scheme where the PCM 150 has a high-side driver and the module 160 has a pull-down resistor to ground, with driver 154 illustrated via a switch. In this scenario an short to ground or an open of signal 180 during the initial period during which the PCM initializes (e.g., 150 milliseconds in this example) results in no un-commanded fuel pump voltage application, and an short to power of signal 180 during the initial period during which the PCM initializes results in up to 150 milliseconds of un-commanded fuel pump voltage application.

Figure 5B:
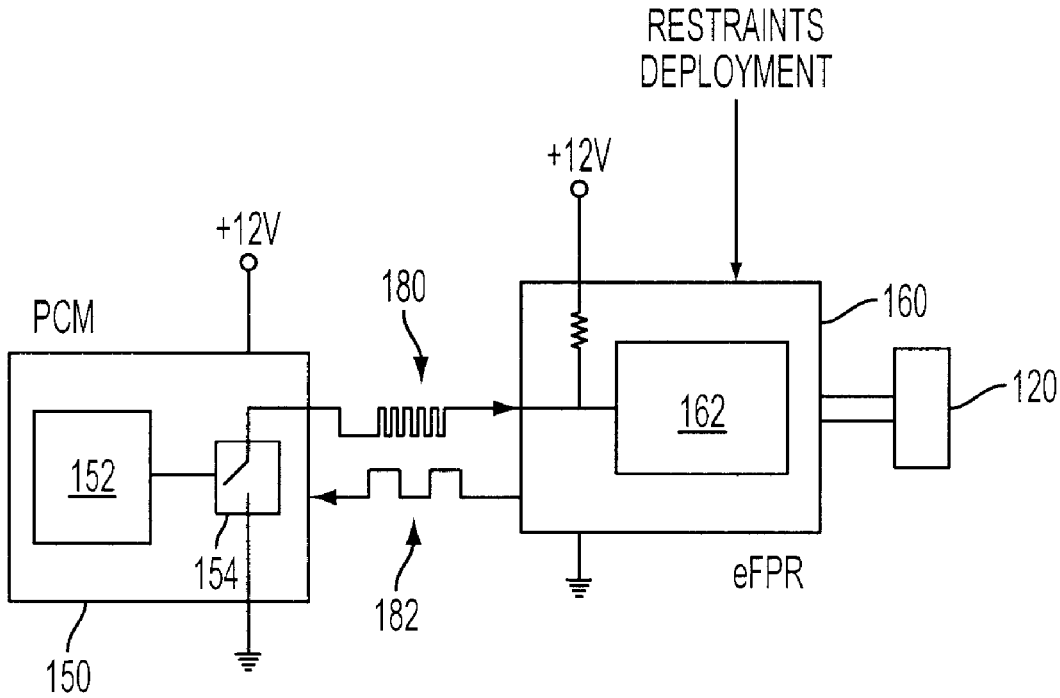

Alternatively, as shown in FIG. 5B, the PCM 150 includes a low-side driver and module 160 has a pull-up resistor to power. In this scenario a short to ground or an open of signal 180 during the initial 150 milliseconds results in up to 150 milliseconds of un-commanded fuel pump voltage application, and a short to power of signal 180 during the initial 150 milliseconds results in no un-commanded fuel pump voltage application.

While the above examples illustrate various configurations to enable faster fuel pump activation, while managing cost and degradation performance, still other variations may be used. For example, the PCM may be configured to generate mid-range signals as a default signal (e.g., output signal 180 having a 150 Hz square-wave as its default state, which can operate while PCM microcontroller is in rest or being initialized). In this case, module 160 can utilize alternative first and second mappings to accept such a state. Further, the PCM may be configured to issue a constant analog voltage on signal 180 between 0 and battery as its default state. Module 160 can then be configured to identify such a command as a pump on command during first 150 milliseconds of operation. However, such an example may include various modifications to module 162, for example.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied with various combinations of different engine, transmission, motor configurations. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling a fuel injection system of a vehicle, the method comprising:

generating fuel pressure via an electronically controlled pump, the electronically controlled pump actuated responsive to a fuel pump command;

during an initial start-up duration, generating the fuel pump command via a first mapping to drive the pump, where the first mapping includes mapping a default signal to active pump operation;

after the initial start-up duration, generating the fuel pump command via a second mapping to drive the pump where the second mapping includes mapping the default signal to pump deactivation;

generating fuel pressure via the electronically controlled pump and a second pump; and generating the fuel pump command in a first module, and generating the fuel pump command in a second module, where the second module has a faster initialization than the first module; and directly injecting pressurized fuel into an engine, wherein the pump is an electronically controlled lift pump.

2. The method of claim 1 where the first module provides the default signal upon receiving electrical power.

3. The method of claim 2 wherein the first module receives electrical power upon a key-on event.

4. The method of claim 3 further comprising, after the initial start-up duration adjusting the fuel pump command based on operating conditions.

5. The method of claim 4 where the first module adjusts the fuel pump command based on operating conditions, and where the initial start-up duration includes initialization of a powertrain control module in a control system of the vehicle.

6. A method for controlling a fuel injection system of a vehicle having a direct injection engine system and including an electronically controlled, multi-speed, lift pump, a mechanical high pressure pump, a plurality of direct cylinder injectors receiving fuel pressured by both the lift pump and the high pressure pump, the method comprising:

generating a fuel pump command in an engine control module, including generating a default signal during initialization of the engine control module; and receiving the fuel pump command at a fuel pump module, the fuel pump module generating a fuel pump drive signal, the drive signal transmitted to the lift pump; where the fuel pump module generates the fuel pump drive signal responsive to the default signal during an initial start-up duration, and generates the fuel pump drive signal irrespective of the default signal after an initial start-up duration, where the initial start-up duration is a time limit and where the fuel pump module passes through mid-range duty cycle commands both before and after the time limit, and where the fuel pump module passes a signal corresponding to fully active fuel lift pump operation only after the time limit.

7. The method of claim 6 where the fuel pump command includes a duty cycle command.

8. The method of claim 7 where the duty cycle command is active high.

9. The method of claim 7, the direct injection engine system further comprising an ignition signal coupled to the engine control module and not coupled to the fuel pump control module.

10. The method of claim 7 where the engine control module adjusts the fuel pump command responsive to engine operating conditions.

11. The method of claim 10 where the initial start-up duration is responsive to a key-on event.

12. The method of claim 6 where the lift pump is a two-speed pump.

13. The method of claim 6 where the lift pump is coupled in a fuel tank.

14. A method for controlling a fuel injection system of a vehicle having a direct injection engine system including an electronically controlled, multi-speed, lift pump, a mechanical high pressure pump, a plurality of direct cylinder injectors receiving fuel pressured by both the lift pump and the high pressure pump, an engine control module, and a fuel pump module, the method comprising:

generate a fuel pump duty cycle command via the engine control module, where the duty cycle command includes a default signal provided during initialization of the engine control module, and receiving the duty cycle command at the fuel pump module, the fuel pump module generating a fuel pump duty cycle drive signal, the drive signal transmitted to the lift pump, where the fuel pump module further generates the fuel pump drive signal responsive to the default signal during an initial start-up duration, and generates the fuel pump drive signal irrespective of the default signal after an initial start-up duration, where the fuel pump module passes through mid-range duty cycle commands both before and after the initial start-up duration, and where the fuel pump module passes a signal corresponding to fully active fuel lift pump operation only after the initial start-up duration.

15. The method of claim 14 where the fuel pump module modifies the fuel pump duty cycle command being passed through by a factor greater than one.

16. The method of claim 14 where the engine control module modifies the fuel pump duty cycle command responsive to a fuel rail pressure sensor.

* * * * *